US006250855B1

(12) United States Patent
Persson et al.

(10) Patent No.: US 6,250,855 B1
(45) Date of Patent: Jun. 26, 2001

(54) COATED MILLING INSERT

(75) Inventors: Jeanette Persson, Nacka; Leif Åkesson, Älvsjö; Rickard Sundström, Johanneshov; Åke Östlund, Hägersten, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/534,006

(22) Filed: Mar. 24, 2000

(30) Foreign Application Priority Data

Mar. 26, 1999 (SE) ..... 9901149

(51) Int. Cl.[7] ..... B23B 27/14

(52) U.S. Cl. ..... 407/119; 407/118; 428/216; 51/309

(58) Field of Search ..... 407/118, 119; 408/144, 145; 428/216, 468, 469; 51/309

(56) References Cited

U.S. PATENT DOCUMENTS 5,705,263 * 1/1998 Lenander et al. ..... 428/216
5,776,588 * 9/1998 Moriguchi et al. ..... 407/119 X
5,882,777 * 3/1999 Kukino et al. ..... 407/119 X
5,945,207 * 8/1999 Kutscher et al. ..... 407/119 X
6,015,614 * 1/2000 Ruppi ..... 407/119 X
6,086,959 * 7/2000 Inspektor ..... 427/419
6,096,436 * 8/2000 Inspektor ..... 428/469
6,117,533 * 9/2000 Inspektor ..... 428/216

FOREIGN PATENT DOCUMENTS 701 982 3/1996 (EP) .
737756 10/1996 (EP) .

* cited by examiner

*Primary Examiner*—Henry Tsai
(74) *Attorney, Agent, or Firm*—Burns, Doane, Swecker & Mathis, L.L.P.

(57) ABSTRACT

A coated cemented carbide cutting tool (indexable inserts) for the wet or dry milling, particularly at high cutting speeds, of stainless steels of different composition and microstructure, but also for the milling of non-stainless steels such as low carbon steels and low and medium alloyed steels is disclosed. The coated WC–Co based cemented carbide insert includes a specific composition range of WC+Co without any addition of cubic carbides by a low W-alloyed Co binder and by a narrow range defined average WC grainsize, and a hard and wear resistant coating including a multilayered structure of sublayers of the composition $(Ti_xAl_{1-x})N$ with repeated variation of the Ti/Al ratio.

10 Claims, 1 Drawing Sheet

COATED MILLING INSERT

BACKGROUND OF THE INVENTION

The present invention relates to a coated cemented carbide cutting tool(indexable inserts) for the milling, particularly at high cutting speeds, of stainless steels of different composition and microstructure such as austenitic, ferritic, duplex, superaustenitic and precipitation hardened stainless steels but also for the milling of non-stainless steels such as low carbon steels and low and medium alloyed steels.

It is well known that for cemented carbide cutting tools used in the machining of steels, the cutting edge is worn by different wear mechanisms such as chemical and abrasive wear, but the tool edge may also fracture under a heavy intermittent cutting load resulting in so called edge chipping which is usually initiated by cracks formed perpendicularly to the cutting edge. This type of cracks are named comb cracks. Furthermore, different cutting conditions such as cutting speed, depth of cut, cutting feed rate and also external conditions, such as dry or wet machining, heavy vibrations of the work piece, etc., require a plurality of different properties of the cutting edge. For example, when applying a carbide cutting insert in the milling of a workpiece of a non-stainless steel or a stainless steel where the surface of the workpiece is covered by so called cast skin, or when milling under difficult external conditions such as heavy vibrations of the workpiece, a coated cemented carbide insert must be used where the insert includes a substrate of a tough cemented carbide grade and on the surface of the substrate, a hard and wear resistant refractory coating is deposited. The coating should be adherently bonded to the substrate and covering all functional parts of the insert. In addition, when milling a stainless steel, still another wear mechanism is active called adhesive wear which is caused by the adhesive force between the stainless steel chip and the cutting edge material. When the adhesive force grows large enough, edge chipping in the vicinity of the above mentioned comb cracks on the cutting edge will occur and, hence, the tool life will be shortened.

When using a cemented carbide cutting tool for the milling of a stainless steel at high cutting speeds (150–300 meter/min depending on the composition of the stainless steel), the thermal energy developed in the cutting edge is considerable and the entire tool edge may plastically deform. This type of wear mechanism is known as plastic deformation wear and, therefore, yet another requirement of the coated cemented carbide insert when being used at high cutting speeds, is that the selection of the carbide composition and the coating material results in a cutting edge exhibiting a high resistance to plastic deformation.

Commercial cemented carbide tools suitable for the machining of stainless steels and, in particular, carbide tools suitable for the milling of stainless steels are usually only optimized with respect to one or two of the required tool properties mentioned above i.e. high resistance to chemical, abrasive, adhesive and plastic deformation wear of a tough cemented carbide substrate coated with a wear resistant and an adherently bonded coating.

WO 97/20083 discloses a coated cemented carbide cutting tool particularly designed for the wet and dry milling of workpieces of low and medium alloyed steels or stainless steels, with or without abrasive surface zones, in machining operations requiring a high degree of toughness of the carbide cutting edge. The external cutting conditions are characterized by complex shapes of the workpiece, vibrations, chip hammering, recutting of the chips etc. The described cutting insert comprises a coated cemented carbide substrate containing WC with an average grain size of 1.7 $\mu$m together with cubic carbides and 11–12 wt % Co, a coating including a layer of $TiC_xN_yO_z$ with a columnar grain structure, a second layer of a smooth, finegrained $\kappa$-$Al_2O_3$ and an outermost third layer of TiN.

WO 97/20081 discloses a coated cemented carbide cutting tool particularly designed for the wet and dry milling of low and medium alloyed steels. The described cutting insert comprises a coated cemented carbide substrate containing WC, cubic carbides and Co and a coating including a layer of $TiC_xN_yO_z$ with a columnar grain structure, a second layer of a smooth, finegrained $\kappa$-$Al_2O_3$ and an outermost third layer of TiN.

WO 97/20082 discloses a coated cemented carbide cutting tool particularly designed for the wet turning of stainless steel components in machining operations requiring a high degree of toughness of the carbide cutting edge. The described cutting insert comprises a coated cemented carbide substrate with a cobalt binder phase enriched in W, a coating including a layer of $TiC_xN_yO_z$ with a columnar grain structure, a second layer of $\kappa$-$Al_2O_3$, and an outermost third layer of TiN. A very smooth cutting edge surface is optionally obtained by brushing the tool edges with brushes based on e.g. SiC.

SUMMARY

It has now been found that excellent cutting performance in the milling of stainless steels at high cutting speeds can be obtained with a coated cemented carbide body comprising a substrate based on WC+Co without any additions of cubic carbides and with a specific grainsize range of the WC grains, a specific composition range of WC+Co and a coating including an innermost, very thin layer of TiN, a second layer of TiAlN with a periodic variation of the Ti/Al ratio along the normal to the substrate/coating interface, and an outermost layer of TiN.

Accordingly, the present invention provides a coated cemented carbide cutting tool for wet or dry machining, particularly at high cutting speeds, of stainless steels of different composition and microstructure, and of low and medium alloyed non-stainless steels, comprising: a WC–Co based cemented carbide body which comprises a WC+Co composition in the range of 10–12 wt % Co, 0.3–0.6 wt % Cr, an average WC grain size in the range of 1.0–1.6 $\mu$m and a low W-alloyed binder phase with a CW-ratio in the range of 0.87–0.96; and a hard and wear resistant coating having a thickness of 1 to 8 $\mu$m on said body that comprises: a first innermost thin layer of TiN; a second layer comprising a multilayered structure of 0.05–0.2 $\mu$m thick sublayers of the composition $(Ti_xAl_{1-x})N$ in which x varies repeatedly between the two ranges $0.45<x<0.55$ and $0.70<x<0.80$, the first sublayer of $(Ti_xAl_{1-x})N$ adjacent to the first TiN layer having an x-value in the range $0.45<x<0.55$, the second sublayer of $(Ti_xAl_{1-x})N$ having an x-value in the range $0.70<x<0.80$ and the third sublayer having x in the range $0.45<x<0.55$ and so forth repeated until 12 to 25 sublayers are being built up; a third 0.1–0.5 $\mu$m thick layer of $(Ti_xAl_{1-x})N$, where x is found in the range $0.45<x<0.55$; and a fourth outermost thin layer of TiN, where the thickness of the second layer constitutes 75–95% of the total coating thickness.

The present invention also provides a coating for a cemented carbide substrate having a thickness of between 1 and 8 $\mu$m, comprising: a first innermost thin layer of TiN; a second layer, comprising a multilayered structure of 12 to 25

0.05 to 0.2 ,μm thick alternating sublayers of the composition $(Ti_xAl_{1-x})N$ in which x is either in a first range of between 0.45 and 0.55 or in a second range of between 0.70 and 0.80, the first sublayer adjacent the first TiN layer and subsequent odd sublayers having an x-value in the first range, and the second and subsequent even sublayers having a x-value in the second range; a third 0.1 to 0.5 μm thick layer of $(Ti_xAl_{1-x})N$, where x is 0.45 to 0.55; and a fourth outermost layer thin layer of TiN; where the second layer constitutes 75–95% of the total coating thickness.

DETAILED DESCRIPTION OF PREFERRED EMBODIMENTS

Figure 1:
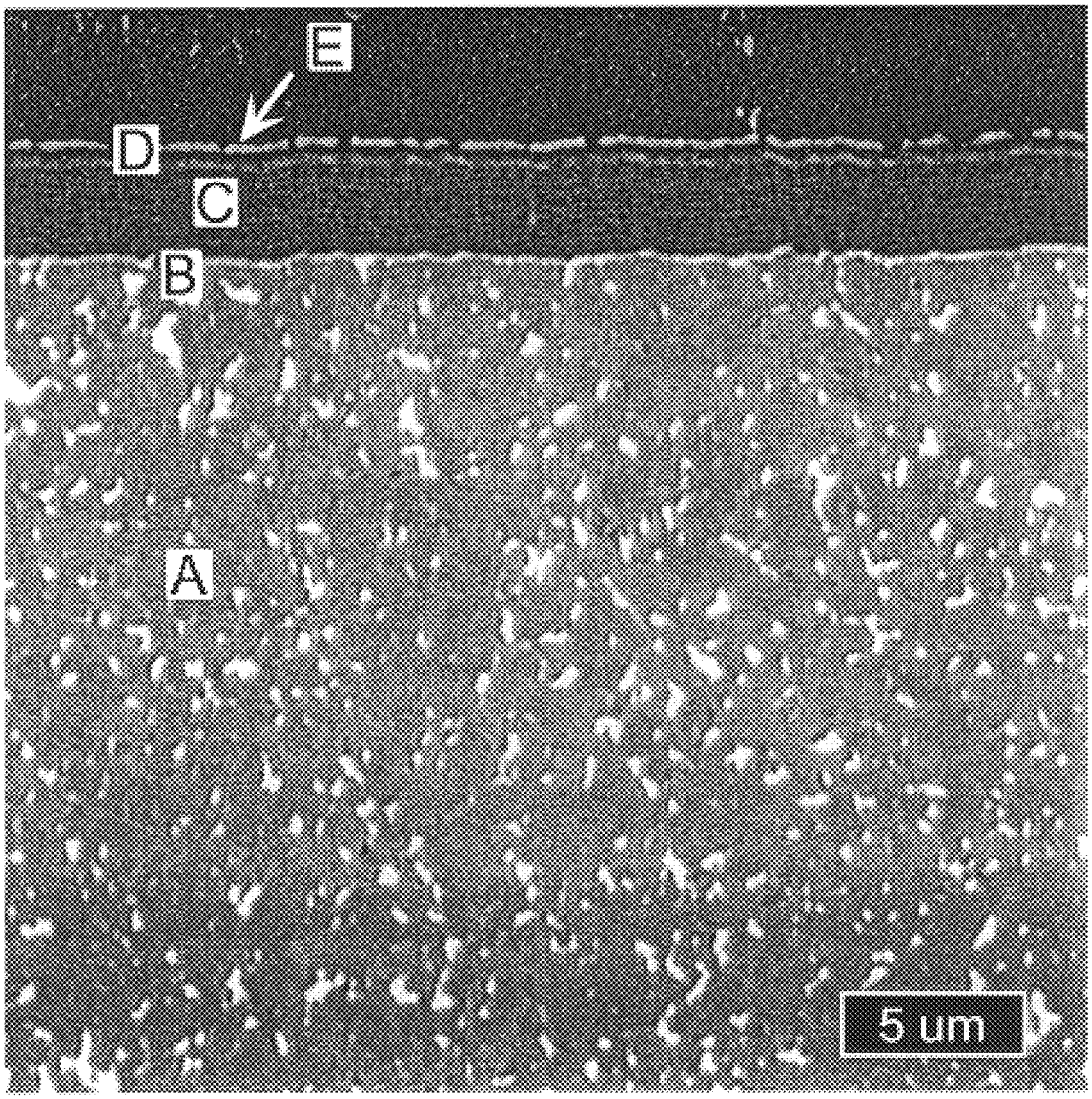
FIG. 1 is a micrograph of a polished cross section of a coated insert according to the present invention.

In FIG. 1, the micrograph of the polished cross section of the coated insert shows the cemented carbide body (A) on which the coating is applied. The coating comprises an innermost TiN layer (B), a layer of several $(Ti_xAl_{1-x})N$ sublayers (C), a further layer of $(Ti_xAl_{1-x})N$ (D) and an outermost TiN layer.

According to the present invention there is provided a coated cutting tool insert for the milling of stainless steels at high cutting speeds comprising a WC–Co based cemented carbide body including a small amount of Cr and with a composition of WC+Co in the range of 10–12 wt % Co, preferably 10–11 wt % Co and most preferably 10.2–10.8 wt % Co, and a Cr concentration in the range of 0.3–0.6 wt %, preferably 0.4–0.5 wt % and the balance is made up by WC. The average WC grainsize is found in the range of 1.0–1.6 μm, preferably 1.1–1.4 μm and most preferably 1.15–1.3 μm. The grainsize of WC is highly affected by the Cr concentration. The cobalt binder phase is alloyed with a small amount of W and the concentration of W in the binder phase can be expressed as the CW-ratio ($CW=M_s/(wt\%\ Co*0.0161)$), where $M_s$ is the measured saturation magnetization of the cemented carbide body in kA/meter and wt % Co is the weight percentage of Co in the cemented carbide. The saturation magnetization depends on the concentration of W in the binder phase, hence, the CW-value is a function of the W content in the Co binder phase as well. A large CW-value corresponds to a low W-content in the binder phase. For improved cutting performance, according to the present invention, the cemented carbide substrate should have a CW-ratio in the range of 0.87–0.96, preferably 0.88–0.95, and most preferably 0.89–0.93. The cemented carbide substrate preferably should not contain any free graphite.

The hard and wear resistant refractory coating deposited on the cemented carbide substrate according to the present invention comprises.

- a first (innermost) thin preferably 0.1–0.5 μm, bonding layer of TiN
- a second layer comprising a multilayered structure of sublayers of the composition $(Ti_xAl_{1-x})N$ in which x varies repeatedly between the two ranges 0.45<x<0.55 and 0.70<x<0.80. The first sublayer of $(Ti_xAl_{1-x})N$ adjacent to the TiN bonding layer has an x-value in the range 0.45<x<0.55, the second sublayer of $(Ti_xAl_{1-x})N$ has an x-value in the range 0.70<x<0.80 and the third sublayer having x in the range 0.45<x<0.55 and so forth repeated until 12–25 sublayers, preferably 22–24 sublayers, are being built up. The thickness of this second layer comprising a multilayered structure of sublayers constitutes 75–95% of the total coating thickness. The individual sublayers of $(Ti_xAl_{1-x})N$ are essentially of the same thickness but their thickness may also vary in a regular or irregular way and said sublayer thickness is generally found in the range of 0.05–0.02 μm.
- a third thin 0.1–0.5 μm layer of $(Ti_xAl_{1-x})N$ having an x-value in the range 0.45<x<0.55.
- a fourth (outermost) thin preferably 0.1–0.2 μm layer of TiN.

The total thickness of the coating deposited on the cemented carbide substrate according to the present invention may vary in the range of 1–8 μm, preferably 2–5 μm. The layer thickness, the sublayer thickness and the coating thickness quoted above refers to measurements made close to the cutting edge, i.e. the functional part of the cutting tool.

The present invention also relates to a method of making a coated cutting tool insert for the milling of stainless steels at high cutting speeds comprising a WC–Co based cemented carbide body including a small amount of Cr and with a composition of WC+Co in the range of 10–12 wt % Co, preferably 10–11 wt % Co and most preferably 10.2–10.8 wt % Co, and a Cr concentration in the range of 0.3–0.6 wt %, preferably 0.4–0.5 wt % and the balance is made up by WC. The average WC grainsize is found in the range of 1.0–1.6 μm, preferably 1.1–1.4 μm and most preferably 1.15–1.3 μm.

The hard and wear resistant refractory coating is deposited onto the cemented carbide substrate by applying conventional PVD (Physical Vapor Deposition) or CVD (Chemical Vapor Deposition) methods and according to the present invention said coating comprises:

- a first (innermost) thin, preferably, 0.1–0.5 μm bonding layer of TiN
- a second layer comprising a multilayered structure of sublayers of the composition $(Ti_xAl_{1-x})N$ in which x varies repeatedly between the two ranges 0.45<x<0.55 and 0.70<x<0.80. The first sublayer of$(Ti_xAl_{1-x})N$ adjacent to the TiN bonding layer having an x-value in the range 0.45<x<0.55, the second sublayer of $(Ti_xAl_{1-x})N$ having an x-value in the range 0.70<x<0.80 and the third sublayer having x in the range 0.45<x<0.55 and so forth repeated until 12–25 sublayers, preferably 22–24 sublayers, are being built up. The thickness of this second layer comprising a multilayered structure of sublayers constitutes 75–95% of the total coating thickness. The individual sublayers of $(Ti_xAl_{1-x})N$ are essentially of the same thickness but their thickness may also vary in a regular or irregular way and said sublayer thickness is found in the range of 0.05–0.2 μm.
- a third thin 0–1–0.5 μm layer of $(Ti_xAl_{1-x})N$ having an x-value in the range 0.45<x<0.55.
- a fourth (outermost) thin, preferably 0.1–0.2 μm, layer of TiN.

EXAMPLE 1

A. Cemented carbide milling inserts according to the invention with the composition 10.5 wt % Co, 0.44 wt % Cr and balance made up by WC and with an average WC grainsize of 1.25 μm, with a binder phase alloyed with W corresponding to a CW-ratio of 0.91, were coated with a 4 μm thick coating by applying conventional PVD cathodic arc technique. The coating comprised a first (innermost) 0.2 μm layer of TiN followed by a 3.2 μm thick second layer comprising 23 alternating sublayers of $(Ti_xAl_{1-x})N$, where x alternatively varied between 0.50 and 0.75, and a third 0.2 μm $(Ti_xAl_{1-x})N$ layer where x=0.50, and, finally, an outermost 0.4 μm layer of TiN.

B. Cemented carbide milling inserts with the composition 11.5 wt % Co, 1.25 wt % TaC, 0.30 wt % NbC and balance made up by WC with an average WC grainsize of 1.7 μm, with a binder phase alloyed with W corresponding to a CW-ratio of 0.93 were coated with a 0.5 μm equiaxed $TiC_{0.05}N_{0.95}$-layer (with a high nitrogen content corresponding to an estimated C/N-ratio of 0.05) followed by a 4 μm thick $TiC_{0.54}N_{0.46}$ layer with a columnar microstructure, by applying a MTCVD technique (Medium Temperature CVD). Subsequently a 1.0 μm thick layer of $Al_2O_3$ followed by a 0.3 μm layer of TiN were deposited on top of the $TiC_{0.54}N_{0.46}$ layer by applying a conventional CVD-technique. The outer TiN layer and almost all of the $Al_2O_3$ layer were removed along the edge line by brushing.

C. Commercial cemented carbide inserts, a cemented carbide grade with the composition 8.9 wt % Co, 0.1 wt % TiC, 0.5 wt % TaC, 0.1 wt % NbC and balance made up by WC, and a CW-ratio of 0.97. The average WC grainsize was 2.5 μm. The inserts had been coated with a conventional CVD-coating comprising of a 4.5 μm TiN/TiCN/TiC layer.

Operation: Face milling-roughing (dry milling)

Cutter diameter: 80 mm

Work-piece: A bar with the dimensions 200×250×400 mm containing several holes with a diameter of 15 mm.

Material: Austenitic stainless steel, SS2343, hardness 180 HB

Cutting speed: 168 m/min

Feed rate/tooth: 0.25 mm/tooth.

Depth of cut: 3 mm

Insert-style: SEKN 1203

| Results: | Milling length (meter): |
|---|---|
| Inserts A: (invention) | 1.2 |
| Inserts B: (prior art) | 0.3 |
| Inserts C: (prior art) | 0.4 |

The tool-life criterion was chipping of the cutting edge line with subsequent tool breakage.

EXAMPLE 2

D. Commercial cemented carbide inserts, a cemented carbide grade with the composition 9.3 wt % Co, 0.5 wt % TaC, 0.1 wt % NbC and balance made up by WC, and a CW-ratio of 0.93. The average WC grainsize was 2.0 μm. The inserts had been coated with a conventional CVD-coating comprising of a 5 μm TiC/TiCN/TiN layer.

Inserts from A, B, C and D were tested in a milling operation.

Operation: Face milling (dry milling, light vibrations)

Cutter diameter: 100 mm

Work-piece: Skidrail

Material: Austenitic stainless steel (W. No. 1.4825) with light cast skin

Cutting speed: 160 m/min

Feed rate/tooth: 0.27 mm/tooth

Depth of cut: 3–5 mm

Insert-style: SEKR 1203

| Results: | Tool-life (minutes) |
|---|---|
| Inserts A: (invention) | 36 |
| Inserts B: (prior art) | 15 |
| Inserts C: (prior art) | 10 |
| Inserts D: (prior art) | 20 |

Tool-life criteria were edge-line chipping and flank wear on the cutting edge. Inserts C and D also suffered from slice fractures on the rake face.

EXAMPLE 3

E. Cemented carbide milling inserts with a composition close to the inserts A (invention) but with 9.8 wt % Co, 0.43 wt % Cr and balance made up by WC and with an average WC grainsize of 0.8 μm, with a binder phase alloyed with W corresponding to a CW-ratio of 0.85, were coated with a 3 μm thick TiCN layer by applying known PVD-technique.

Inserts from A, B and E were tested in a milling operation.

Operation: Face milling, semi-finishing (dry machining, no skin)

Cutter diameter: 32 mm

Work-piece: Bar with a diameter of 97 mm

Material: Precipitation hardened ferritic/martensitic steel (AISI 17–4 PH)

Cutting speed: 179 m/min

Feed rate/tooth: 0.16 mm/tooth

Depth of cut: 2 mm

Insert-style: R390-11T308

| Results: | Tool-life (minutes) |
|---|---|
| Inserts A: (invention) | 3.3 |
| Inserts 8: (prior art) | 1.4 |
| Inserts E: (prior art) | 2.0 |

EXAMPLE 4

F. Commercial cemented carbide inserts, a cemented carbide grade with the composition 12.5 wt % Co, 1.7 wt % TaC, 0.2 wt % NbC and balance made up by WC, and a CW-ratio of 0.85. The average WC grainsize was 1–2 μm. The inserts had been coated with a PVD-coating comprising a 3 μm TiCN layer. Inserts from A, D and F were tested in a milling operation.

Operation: Face milling, finishing (dry milling)

Cutter diameter: 100 mm

Work-piece: Bar, 80×152 mm

Material: Austenitic stainless steel, AISI 304

Cutting speed: 264 m/min

Feed rate/tooth: 0.15 mm/tooth

Depth of cut: 2 mm

Insert-style: R245-12T308E (for inserts F., SEKT1204AFR)

| Results: | Tool-life (minutes) |
|---|---|
| Inserts A: (invention) | 12 |
| Inserts E: (prior art) | 5 |
| Inserts F: (prior art) | 6 |

EXAMPLE 5

Inserts from A, D, B and F were tested in a milling operation

Operation: Side milling, finishing (dry milling, no skin)

Cutter diameter: 32 mm

Work-piece: Part of a valve component

Material: Autenitic stainless steel, AISI 316

Cutting speed: 120 and 264 m/min

Feed rate/tooth: 0.10 mm/tooth

Depth of cut: 5 mm

Insert-style: R390-12T308

| | Tool-life (minutes) Cutting speed: | |
|---|---|---|
| Results: | 120 m/min | 264 m/min |
| Inserts A: (invention) | 30 | 17 |
| Inserts B: (prior art) | 20 | 4 |
| Inserts E: (prior art) | 22 | 13 |
| Inserts F: (prior art) | 24 | 9 |

Tool-life criterion at the lower cutting speed was build-up edge formation on the tool edge and subsequent edge line chipping and the tool-life criterion at the higher cutting speed was flank wear of the main cutting edge and comb crack formation leading to fracture of the tool edge.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A coated cemented carbide cutting tool for wet or dry machining of stainless steels of different composition and microstructure, and of low and medium alloyed non-stainless steels, comprising:

a WC–Co based cemented carbide body which comprises a WC+Co composition in the range of 10–12 wt % Co, 0.3–0.6 wt % Cr, an average WC grain size in the range of 1.0–1.6 μm and a low W-alloyed binder phase with a CW-ratio in the range of 0.87–0.96; and a hard and wear resistant coating having a thickness of 1 to 8 μm on said body that comprises a first innermost thin layer of TiN a second layer comprising a multilayered structure of 0.05–0.2 μm thick sublayers of the composition $(Ti_xAl_{1-x})N$ in which x varies repeatedly between the two ranges $0.45<x<0.55$ and $0.70<x<0.80$, the first sublayer of $(Ti_xAl_{1-x})N$ adjacent to the first TiN layer having an x-value in the range $0.45<x<0.55$, the second sublayer of $(Ti_xAl_{1-x})N$ having an x-value in the range $0.70<x<0.80$ and the third sublayer having x in the range $0.45<x<0.55$ and so forth repeated until 12 to 25 sublayers are being built up, a third 0.1–0.5 μm thick layer of $(Ti_xAl_{1-x})N$, where x is found in the range $0.45<x<0.55$ a fourth outermost thin layer of TiN where the thickness of the second layer constitutes 75–95% of the total coating thickness.

2. The cutting insert of claim 1, wherein the cemented carbide body comprises a WC+Co composition in the range of 10.0–11.0 wt % Co, 0.4–0.5 wt % Cr, an average WC grainsize in the range of 1.1–1.4 μm, a CW-ratio in the range of 0.88–0.95 and a total coating thickness of 2–5 μm.

3. The cutting insert of claim 1, wherein the cemented carbide body is free from graphite.

4. A method of making a coated cemented carbide cutting tool insert, the coated insert comprising a WC–Co based cemented carbide body comprising a WC–Co composition in the range of 10–12 wt % Co, 0.30–0.6 wt % Cr with an average WC grainsize in the range of 1.0–1.6 μm and a low W-alloyed binder phase with a CW-ratio in the range of 0.87–0.96, the method comprising depositing on the body, a coating comprising a first innermost thin layer of TiN a second layer comprising a multilayered structure of 0.05–0.2 μm thick sublayers of the composition $(Ti_xAl_{1-x})N$ in which x varies repeatedly between the two ranges $0.45<x<0.55$ and $0.70<x<0.80$, the first sublayer of $(Ti_xAl_{1-x})N$ adjacent to the first TiN layer having an x-value in the range $0.45<x<0.55$, the second sublayer of $(Ti_xAl_{1-x})N$ having an x-value in the range $0.70<x<0.80$ and the third sublayer having x in the range $0.45<x<0.55$ and so forth repeated until 12 to 25 sublayers are built up a third 0.1–0.5 μm thick layer of $(Ti_xAl_{1-x})N$, where x is found in the range $0.45<x<0.55$ a fourth outermost thin layer of TiN making the total coating thickness close to the cutting edge vary in the range of 1–8 μm and where the thickness of the second layer constitutes 75–95% of the total coating thickness.

5. The method of claim 4 wherein said cemented carbide body comprises a WC–Co composition preferably in the range of 10.0–11.0 wt % Co, 0.4–0.5 wt % Cr, an average WC grainsize in the range of 1.1–1.4 μm and a CW-ratio in the range of 0.88–0.95, and the total coating thickness close to the cutting edge is 2–5 μm.

6. The method of claim 4, wherein the coating is deposited using a CVD technique.

7. The method of claim 4, wherein the coating is deposited using a PVD technique.

8. A coating for a substrate comprising:

a first innermost thin layer of TiN;

a second layer, comprising a multilayered structure of 12 to 25 0.05 to 0.2 μm thick alternating sublayers of the composition $(Ti_xAl_{1-x})N$ in which x is either in a first range of between 0.45 and 0.55 or in a second range of between 0.70 and 0.80, the first sublayer adjacent the first TiN layer and subsequent odd sublayers having an x-value in the first range, and the second and subsequent even sublayers having a x-value in the second range;

a third 0.1 to 0.5 μm thick layer of $(Ti_xAl_{1-x})N$, where x is 0.45 to 0.55; and a fourth outermost layer thin layer of TiN;

where the second layer constitutes 75–95% of the total coating thickness.

9. The coating of claim 8, wherein the coating has a total thickness of 1–8 μm.

10. The coating of claim 8, wherein the coating has a total thickness of 2–5 μm.

* * * * *